United States Patent [19]

MacLean

[11] 4,137,439

[45] Jan. 30, 1979

[54] SELECTOR SWITCH RELAY

[75] Inventor: Alexander MacLean, Hingham, Mass.

[73] Assignee: Electro Switch Corp., Weymouth, Mass.

[21] Appl. No.: 809,900

[22] Filed: Jun. 24, 1977

[51] Int. Cl.[2] ..... H01H 3/00; H01H 21/04

[52] U.S. Cl. ..... 200/153 L; 200/67 B

[58] Field of Search ..... 200/153 L, 153 LA, 153 N, 200/153 LB, 67 PK, 67 G, 154, 244, 336, 63 R, 65, 155 R, 329, 330, 67 B

[56] References Cited

U.S. PATENT DOCUMENTS

| | | | |
|---|---|---|---|
| 1,434,972 | 11/1922 | Tizley | 200/63 R |
| 1,969,293 | 8/1934 | Bissell | 200/153 LB |
| 2,823,278 | 2/1958 | Carlson et al. | 200/65 |
| 4,001,740 | 1/1977 | MacLean | 335/190 X |

*Primary Examiner*—Steven E. Lipman
*Assistant Examiner*—Steven M. Pollard
*Attorney, Agent, or Firm*—Wolf, Greenfield & Sacks

[57] ABSTRACT

A rotary device acts as a switch and relay for manual or remote operation with the use of a rotary solenoid and a unique ratchet and automatic electrical contact opening and closing mechanism. The ratchet coacts with a spring loaded drive bar mounted perpendicular to a central axis of a rotary switch shaft. The drive bar is biased toward a ratchet face which carries a plurality of angularly arranged inclined surfaces. A detent wheel is fixed to the shaft with a pair of springs maintaining the detent wheel in a first position. A rotary solenoid is attached to the ratchet wheel and acts to drive the ratchet wheel to in turn cause rotation of the detent wheel and changing of switch positions.

An automatic electrical contact opening and closing mechanism used with the rotary selector switch relay device has a first spring urging a contact arm and contact into a first position with the contact in electrical engagement with a fixed contact. A second spring is mounted to assert a second spring force on the contact arm opposed to the urging of the first spring at a preselected time. The second spring force builds in magnitude upon pivoting of the cam track carried by a track arm to overcome the first spring force at a preselected time and cause snap disengagement of the contact and fixed contact.

17 Claims, 9 Drawing Figures

SELECTOR SWITCH RELAY

BACKGROUND OF THE INVENTION

There are numerous applications in the electric power industry where medium power switching devices are needed. Various electromechanical relays, contactors and manually operated selector and control switches are often used. Often such devices are limited in their applications to new demands of electric power systems.

For example, conventional manually operated rotary switches easily provide a large number of electrical poles and positions sometimes required for power switching but are not designed to operate at high speed and often not by means of remote control. Known electromechanical relay and contactors can be operated remotely at high speeds but provide only few contacts when used in medium power switching as from 5 to 30 amps. Often complicated and multiplied switching devices are used in complicated schemes which can add to cost and reduce reliability of power control systems.

SUMMARY OF THE INVENTION

It is an object of this invention to provide a single device that has operating characteristics of both a switch and a relay.

It is another object of this invention to provide a rotary selector switch relay device capable of operating as a switch or relay and capable of remote or manual actuation.

It is still another object of this invention to provide a device in accordance with the preceding objects which can operate a large number of contacts at high speed to provide momentary maintained or stepping functions.

It is still another object of this invention to provide a device in accordance with the preceding objects which has good reliability and is capable of operating in a variety of power control systems.

Still another object of this invention is to provide an improved ratchet means and rotary solenoid combination in an electrical switching device which means maximizes the output of the rotary solenoid.

Still another object of this invention is to provide a highly efficient automatic electrical contact opening and closing mechanism for use with a shaft which is mounted for predetermined arcuate movement about an elongated shaft axis to enable rapid and automatic stepping of a switch shaft.

A rotary selector switch relay device can be operated manually or remotely at high switching speed with high switch shaft torque and using a minimum sized rotary solenoid. The selector switch relay has an axially extending switch shaft carrying a plurality of substantially radially extending contacts with the shaft being mounted for rotation about its axis. A detent wheel is coaxial with the switch shaft and fixed to the shaft. Spring means acts to maintain the detent wheel and shaft in a first portion. A spring loaded drive bar is mounted substantially perpendicular to a central axis of the shaft and resiliently biased in one direction along the axis and reciprocally movable along the axis. The drive bar is preferably mounted in a slot so that radial rotation of the bar about the shaft axis causes corresponding simultaneous rotation of the shaft and detent wheel. A drive ratchet is coaxially mounted with respect to the shaft and engages the drive bar and carries a plurality of angularly arranged inclined or cam surfaces whereby reciprocal arcuate movement of the ratchet causes arcuate movement of the shaft and detent wheel in a single direction at predetermined arcuate increments. A rotary solenoid is attached to the ratchet wheel. The spring means acts to multiply arcuate movement in the shaft over corresponding arcuate movement of the ratchet so that a solenoid with a relatively small degree of arcuate movement and high power can be used to cause a high degree of arcuate movement in the switch shaft.

An automatic electrical contact opening and closing mechanism for use with a shaft which is mounted for predetermined arcuate movement about an elongated shaft axis, has a track arm carrying a cam track with the arm fixed to the shaft for reciprocal arcuate movement therewith. A contact arm is mounted at a pivot point and carries a cam follower pin engaging the cam track. An electrical contact is fixed to the contact arm and a first spring means urges the contact arm and contact with a first spring force into a first position where the contact is in electrical engagement with a fixed contact. A second spring means is mounted to assert a second spring force on the contact arm to oppose and overcome the urging of the first spring means at a preselected time. The second spring force builds in magnitude upon pivoting of the cam track to overcome the first spring force at said preselected time and cause snap disengagement of the contact and fixed contact, with reciprocal pivoting of the cam track causing said first spring force to overcome the second spring force only when the cam track returns to its original arcuate position.

It is a feature of this invention that small sized rotary solenoids can be used yet high power and fast switching obtained. It is preferred to use electrical contacts which are mechanically held in selected position and thus cannot be opened by shock and vibration. Manual operation can be carried out without interfering with remote operation. For example, no matter what the arcuate position of the shaft abouts its axis, caused by manual operation, the remote drive can reliably pick up and index from that point. It is a still further feature that the manual operation can be unidirectional indexing which provides the same contact operation sequence as remote operation.

It is a still further feature that parts can be easily made as for example the symmetrical detent wheel substantially lowers complexity over non-symmetrical detent wheels.

BRIEF DESCRIPTION OF THE DRAWINGS

The above and other features, objects and advantages of the present invention will be better understood from a reading of the following specification in conjunction with the drawings in which.

DESCRIPTION OF PREFERRED EMBODIMENTS

Figure 1:
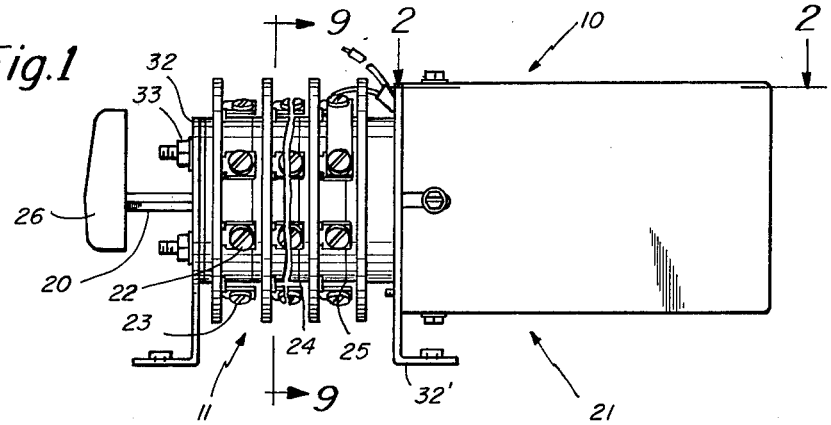
FIG. 1 is a side view of a rotary selector switch relay device in accordance with a preferred embodiment of this invention.
Figure 2:
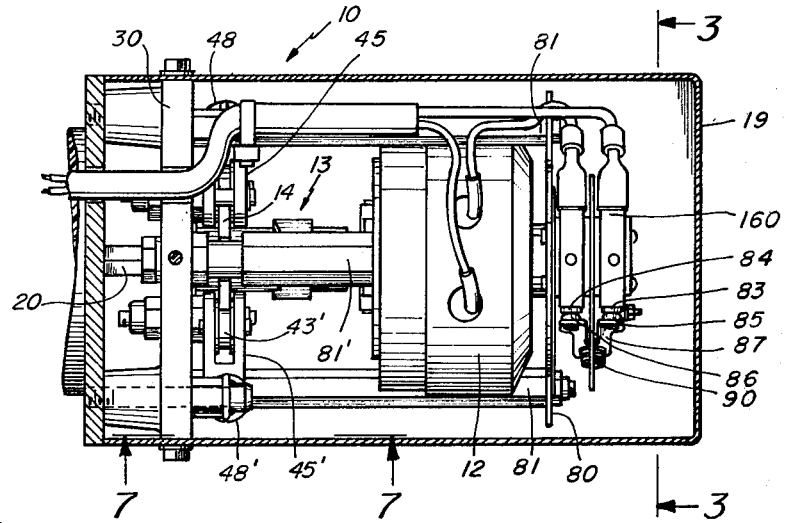
FIG. 2 is a cross sectional plan view on line 2—2 of FIG. 1.

With reference now to the drawings the rotary selector switch relay device is indicated generally at 10 and has a rotary switch section 11, a rotary solenoid 12 driving a ratchet asembly 13 to activate a detent wheel 14 rigidly connected to the switch shaft 20. An automatic electrical contact opening and closing mechanism 15 activates the solenoid 12 to a stepping mode of operation.

The rotary switch section 11 is of substantially conventional design as known in the art and described for example in U.S. Pat. No. 4,001,740 issued Jan. 4, 1977. A switch shaft 20 is mounted on rotary bearings as is conventional for movement about its elongated axis and carries outwardly extending conventional switch contacts 21, 21' which are preferably positioned radially of the shaft. Contacts 22 are positioned in each conventional plastic disc or section at eight equal arcuate positions therearound. The contacts 21, 21' rotate to contact selected ones of the eight radially arranged rows of contacts 22. In addition to the rows, there are columns of contacts, corresponding to the disc segments, which may for example number twenty with representative examples being shown at 23, 24 and 25. The exact numbers of contacts in the columns and rows can be varied as desired. Preferably the contacts 21 carried for rotation with the shaft make mechanical contact with the contacts in the rows and columns as known in the art. In a preferred embodiment, eight rows are used with switching positions at 45 degree increments.

A handle 26 is fixed to the shaft to allow manual rotation of the shaft about its axis for manual operation of the switch. This handle extends out of one end of the device and the other end is covered by a casing 19.

Figure 8:
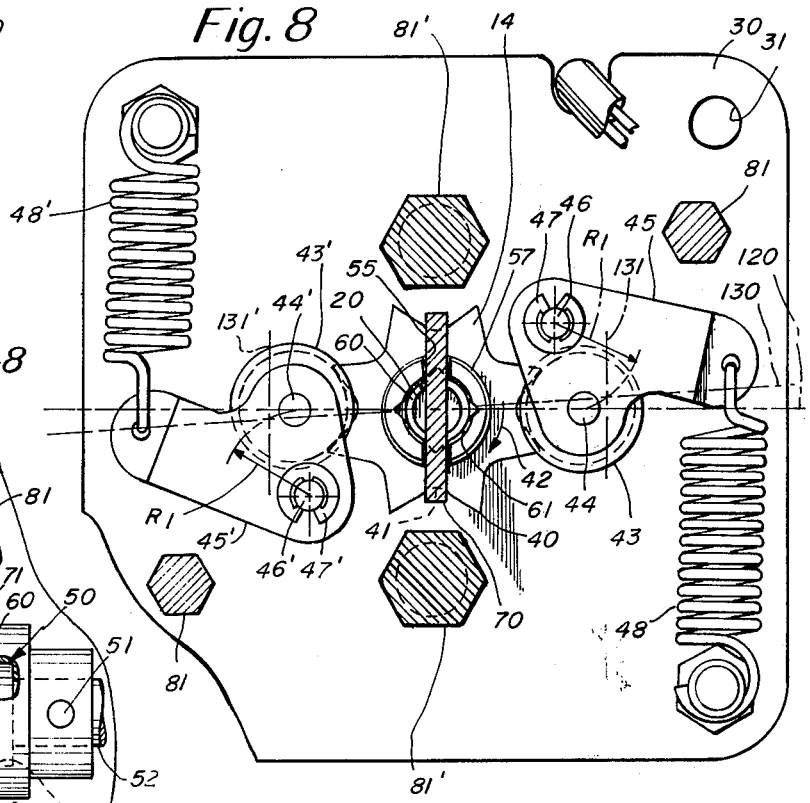
FIG. 8 is a cross sectional view through line 8—8 of FIG. 7.
Figure 7:
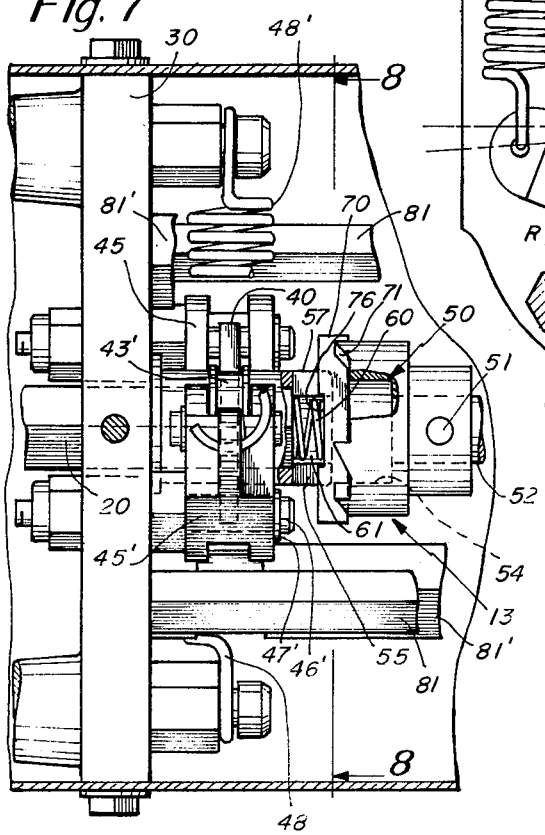
FIG. 7 is a cross sectional side elevation on line 7—7 of FIG. 2.
Figure 9:
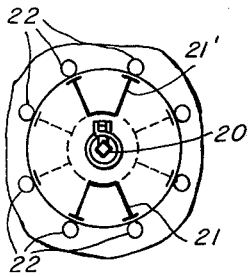
FIG. 9 is a diagrammatic showing of the switch contacts.

Adjacent the rotary switch is the ratchet assembly and detent wheel section which comprises a mounting plate 30 carrying bolts 31 at four corners thereof extending to a forward mounting plate 32'. Mounting plate 32 has four bolts 33 for fixing plastic insulating segments of the contact carriers together between plates 32 and 32' as known in the art. Rear mounting plate 80 is supported by bolts 81 with the solenoid 12 supported by bolts 81'. A detent wheel 14 is fixed to the shaft 20 and is preferably symmetrical about the shaft axis comprising a plurality of peaks 40 and valleys 41. The shaft and detent wheel are mounted for rotation in the direction of arrow 42 (FIG. 8).

The detent wheel 14 and shaft are maintained in position by side loading of rollers 43, 43' each of which are identical and mounted for rotation about pins 44, 44'. Levers 45, 45' on either side of the detent wheel are mounted for rotation about pivot pins 46, 46' and maintained in place by spring retaining rings 47, 47' for pivoting. Springs 48, 48' are mounted at corner rods as best shown in FIG. 8 and resiliently urge the rollers against the detent wheel 14 and maintain the detent wheel in position. The spring action of these spring means will be further described.

The ratchet assembly 13 comprises a ratchet wheel member 50 pinned by pin 51 to the output shaft 52 of the rotary solenoid 12. The ratchet wheel member 50 has a stepped cylindrical passageway 54. The axis of switch shaft 20 is preferably coaxially aligned with the axis of the rotary solenoid shaft 52.

The detent wheel 14 has an elongated neck portion of extension 57 the outer diameter of which mates with cylindrical bore 54. A spring 60 having a diameter such as to mate with a cylindrical recess 61 and lie within an internal recess of the extension piece 57 is provided. A flat elongated drive bar 70 is mounted perpendicular to the axis of the shafts 20 and 52 in slot 55 of extension 57, and spring biased against the ratchet portion 50 by spring 60 which permits the bar to move toward the detent wheel when the ratchet is rotated opposite to the direction of arrow 42 (FIG. 8) with the bar sliding up on the inclined surfaces such as surface 71.

The rotary solenoid 12 can be a small angle rotary solenoid because as will be described, its output will be magnified by the mechanical action of the springs 48, 48'. Thus high power can be obtained with a solenoid that would be larger than the one used if all the power were to result from the rotary action of the solenoid. In the preferred embodiment, the rotary solenoid is one which has 25 degrees of arcuate movement yet the switching positions can be 45 degrees apart.

The rotary solenoid has an automatic electrical contact opening and closing mechanism to open and close the contacts energizing the solenoid and thus permit stepping of the switch automatically if desired. This mechanism is mounted on rear mounting plate 80. The plate 80 carries fixed butt contacts 83, 84 of a circuit for the solenoid and are mounted on a suitable insulated mounting block with both 83 and 84 being considered a single fixed contact for purposes of discussion. Similarly movable butt contacts 85 and 86 will be considered as a single contact for purposes of the discussion. The contacts 85 and 86 are mounted on a Y-shaped conductive support 87 spring biased into engagement with a substantially L-shaped contact arm 88 which carries support 87. The actual mounting between 87 and contact arm 88 is a spring biased arrangement having a spring 90 urging support 87 against the arm 88 while having a stabilizing pin 91 as known. The spring 90 acts on contacts 85, 86 to give contact spring pressure in the closed position and assure thorough contact in the closed position of the switch. The contact arm 88 is mounted for movement about pivot pin 89 with its associated retaining ring 92. A cam pin 93 is fixed on the arm 88 and positioned in a generally sector-shaped cam track 94 carried by a track arm 95 which is in turn fixedly mounted on the output shaft 52 of the solenoid. The arm 95 is fixed on the pivotal shaft 52 by pin 96. A first coil spring 100 is mounted on a pin 101 on the arm 88 and to a stationary pin 102 substantially fixed to support 80. A second coil spring 103 is attached at one end to pin 101 and mounted at another end to an extension of the track arm 95 at pin 105.

Figure 6:
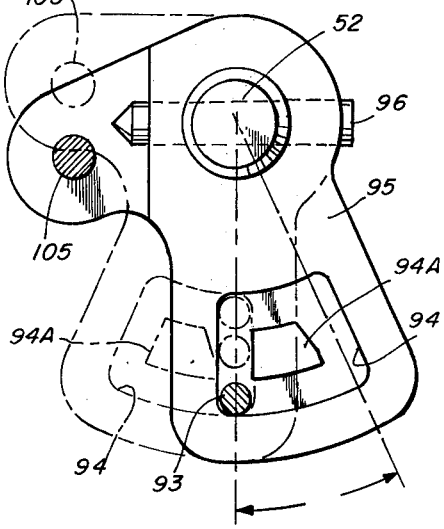
FIG. 6 is an enlarged view of a track arm showing a dotted line view of the track arm in a second position.

As the pin 93 follows the dotted outline path in the direction of arrow 107 due to arcuate movement of track arm 95 (FIG. 6), it will be seen that spring pressure of spring 100 will maintain the contacts in the closed position until point is reached where the buildup of pressure in spring 103 caused by extension of the spring will cause snap action to disengage the contacts.

Turning now to the operation of the rotary selector switch relay device, the handle 26 when rotated provides positive mechanical operation of up to twenty columns and perhaps eight rows or more of switch contacts. Rotation of the shaft by manual operation causes rotation of the bar 70 about the axis of the switch shaft with the bar riding up the inclined surfaces 71 and biased into its position against the ratchet by the spring 60. The ratchet does not move during manual operation but the bar rotates about the shaft axis and moves axially of the shaft as required to overcome the ratchet stationary position. Thus the bar moves toward and away from the detent wheel as required by the angular motion. The bar is prevented from movement perpendicular to the shaft axis by the interfit of spring 60 in recess 76 of the bar. Regardless of where the bar 70 is left after manual operation, it is always in position to be activated by ratchet movement of the ratchet member when the solenoid is activated. Manual operation causes unidirectional indexing of the contacts which provide the same contact operation sequence as provided by remote actuation due to actuation of the solenoid.

The rotary solenoid 12 in the preferred embodiment has an output of 25 degrees with the ratchet 50 having a series of eight angular portions or ramps 71 at 45 degrees cut into the face. The purpose of the angular portions 71 is to engage the drive bar and thus engage with the slotted detent wheel when it turns clockwise. The engagement occurs for only 25 degrees of arcuate turning about the shaft at which point the drive bar 70 and the detent wheel with its slotted extension continue to rotate clockwise as shown in FIG. 8, to a 45 degree switch position while the drive ratchet 50 returns to 0 degrees after slipping past the spring loaded drive bar. The instant the slotted detent wheel locks in at the 45 degree incremental position as shown in FIG. 8, the drive ratchet has returned to 0 degrees, that is its starting position, and the drive bar reengages the ratchet for further switching operation.

The mechanical link between the rotary solenoid 12 and the switch shaft 20 is the drive bar 70 which is free to float both axially and radially in the slot 55 although it is under constant force from the spring 60 urging it toward the ratchet 50. The radial float is limited about the axis of the shaft by the outer diameter of the spring 60 engaging the recess 76 as previously described. The tangential float of the drive bar in the slot 55 is minimal.

It should be noted that the contacts radially mounted on the switch shaft must index 45 degrees between positions. The 25 degree rotary solenoid when operated remotely, drives the detent wheel about 22 ½ degrees or halfway after angular losses. It is the function of the spring assembly connected to the detent wheel to pull the detent wheel the remaining half of the 45 degrees. This is caused by the clockwise rotation of the detent wheel causing the rollers 43, 43' to roll over the appropriate peaks 40 and act on the trailing slopes of the valleys 41. In the rest position the rollers 43, 43', due to the spring action, mechanically lock the detent wheel 14 in position at 45 degree increments by locating in the appropriate valleys. This positions the centers of the rollers 44, 44' exactly on a center line indicated at 120 which corresponds to a switch position. When the detent wheel 14 is rotated by manual or remote operation, the rollers 43, 43' roll up the two appropriate slope surfaces of the valleys while storing energy in the springs 48, 48' as they undergo extension. As the detent wheel 14 rotates clockwise, both roller center lines of pins 44, 44' move counterclockwise along a radii as indicated at R1 in each case. This moves the centerlines of pins 44, 44' from a point exactly on center line 120 to new points defined by center line 130 and vertical lines 131, 131'. This counterclockwise shift causes the rollers 43, 43' to assume driving the detent wheel 3 ½ degrees before the halfway point of 22 ½ degrees. That is, the rotary solenoid need only drive and detent wheel 14 about 19 degrees for the detent wheel to start to index to the 45 degree position under the influence of the springs mounting the rollers 43, 43'.

The 25 degree rotary solenoid 12 can easily index a 22 inch pound load of the selector switch relay device 45 degrees in less than 25 milliseconds when operated remotely. This remote operation has been described thus far as a one-position change. That is when the rotary solenoid is energized, it drives the shaft causing it to index 45 degrees. At this point the solenoid must be deenergized to allow the drive ratchet to return to 0 degrees before the device can be indexed to another position. The control of electric power to the rotary solenoid is preferably used to allow the device to operate as a multiposition, remote operated selector switch. The ratchet assembly coacts in this manner with a control which interrupts power when required and acts to open and close the electrical contact to energize and deenergize the solenoid automatically.

Figure 3:
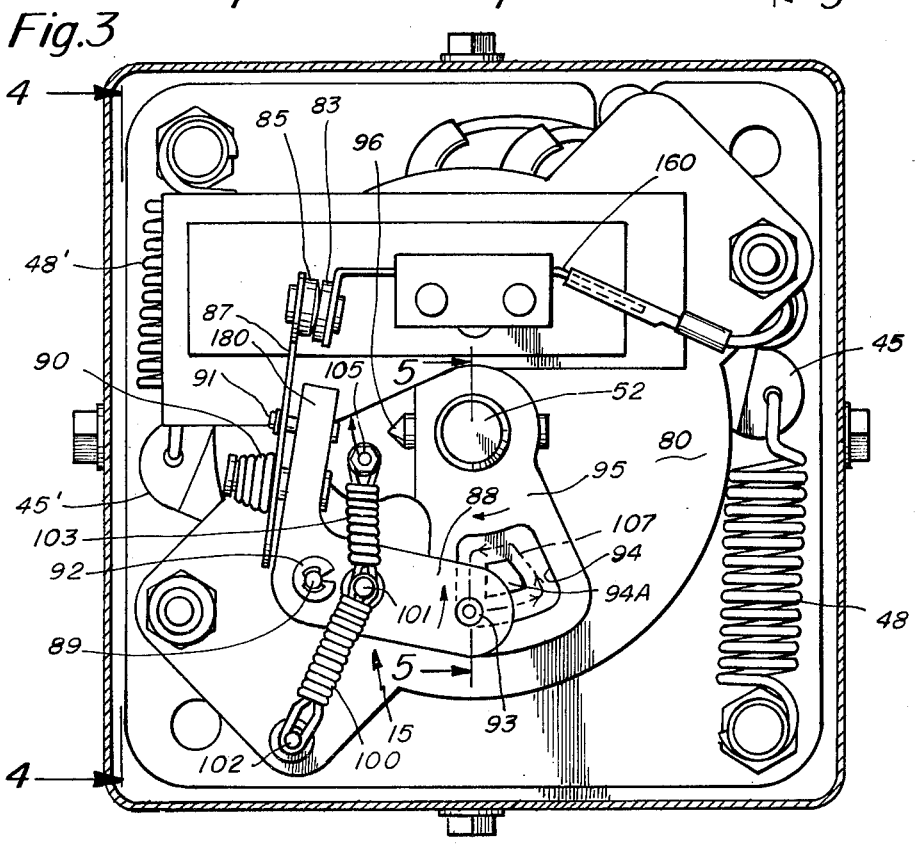
FIG. 3 is a cross sectional view taken through line 3—3 of FIG. 2.
Figure 4:
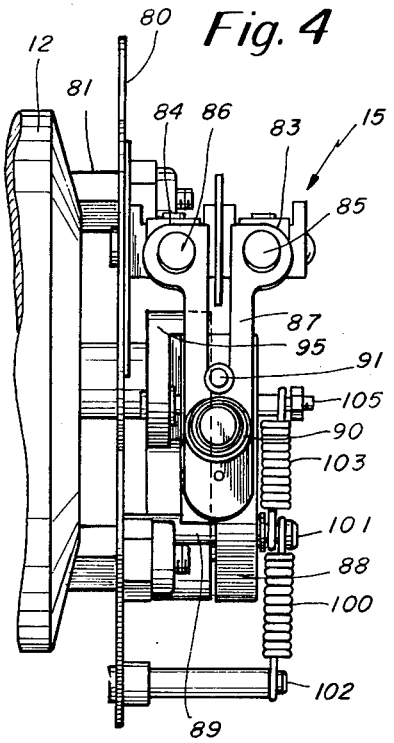
FIG. 4 is a side elevation on sight line 4—4 of FIG. 3.
Figure 5:
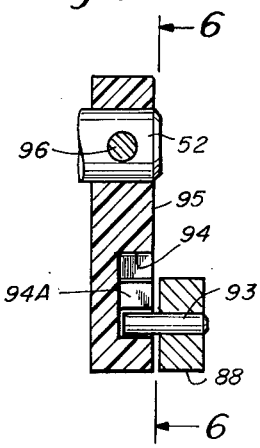
FIG. 5 is a cross sectional view taken on line 5—5 of FIG. 3.

In the preferred embodiment the interrupter contact is closed when the rotary solenoid is at 0 degrees, that is deenergized as best shown in FIG. 3. The contacts remain closed as the solenoid shaft rotates through 25 degrees. Upon completing the 25 degree stroke, the interrupter contact opens, deenergizing the solenoid circuit and remains open, allowing the solenoid to return its drive shaft to 0 degrees by the conventional spring biasing of the solenoid. At 0 degrees, the interrupter contact recloses and once again completes the solenoid coil circuit in a conventional circuit arrangement.

The rotary solenoid 12 is energized to cause the shaft to index when the power is applied to a terminal such as 160 through the closed contacts 83, 85 which are butted and held closed by the spring 90. The force of compression spring 90 is overcome so as to develop about 2 ounces of pressure on the butt contacts. This pressure is sufficient to provide good electrical conductivity at 0 degrees of rotation of the shaft 52 and is maintained during 25 degrees of arcuate movement causes by the solenoid stroke. When the solenoid is energized, the track arm 95 rotates clockwise 25 degrees. As the track arm rotates, pin 93 follows the moving track as indicated by arrow 107. When pin 105 has rotated 12 ½ degrees, it has extended the spring 103 so that the load developed is equal to the load developed by spring 100 now extended between the studs 101 and 102. At this point the contact arm 88 tends to rotate counterclockwise due to the ½ extension on spring 103. However, rotation of spring 100 cannot occur because of the cam arrangement and the pin 93. As the track arm 95 continues to rotate spring 103 increases its loading on the pin 101 and the track arm 95 tends to rotate under a constantly increasing force. When the track arm 95 approaches 25 degrees, or the end of its stroke, the pin 93 starts to slip by the center portion 94A of the cam track 94. This motion results in counterclockwise movement of the contact arm 88 allowing the contacts 83, 85 to start opening. This begins just prior to the track arm 95 reaching 25 degrees of arcuate movement. Contacts 83 and 85 do not actually open until the full 25 degree stroke is accomplished. This results from the angle of the support 87 to the extension portion 180 of the member 88 which angle decreases as pressure is released on the compression spring maintaining the contacts closed until 25 degrees is reached.

When the portion 94A is fully at its 25 degree arcuate movement position, pin 93 rapidly moves from the lower righthand corner of the appendage 94A following the path of arrow 107 causing a snap breaking of the contacts 83, 85 since the spring pressure of spring 103 overcomes the spring pressure of spring 101. This deenergizes the rotary solenoid and it starts to return to 0 degrees. At that point, spring 103 begins to develop a load equal to the load developed by spring 100 and the contact arm 88 starts its tendency to rotate clockwise. However, rotation is prevented by the appendage 94A blocking the pin 93. When pin 93 reaches the upper left-hand corner of the cam track, the arm 88 starts to rotate clockwise and recloses the contacts 83, 85 which completes the rotary solenoid power stroke and reset of the solenoid shaft to 0 degrees.

It is known that a rotary solenoid is a highly inductive, direct current load. Switching loads of this nature often present problems due to excessive contact arcing. Often various methods to eliminate arcing or minimize the damage done by it are utilized. One of these is to have the contacts break at high speed and stretch the arc until it breaks. This method is preferred and is carried out by the automatic electrical contact opening and closing mechanism as described.

While a specific example of the present invention has been shown and described, many variations are possible. For example, while two identical spring assemblies and mounting springs 48, 48' have been shown, in some cases only one spring assembly need be used. Care must be taken to redesign portions of the device so as to prevent unbalance in that case. While the drive bar 70 is preferably mounted for reciprocal axial movement along the shaft, in some cases the ratchet can be spring loaded and the bar stationary in an obvious reversal of parts. This again is not preferred due to the problems of mounting and the like.

While a symmetrical detent wheel 14 is preferred, in some cases nonsymmetrical wheels can be used although this increases machining costs and may make it impossible for the wheel to be used in areas which require clockwise or counterclockwise action.

What is claimed is:

1. A rotary selector switch relay device capable of remote operation at high switching speed, having high torque but using a minimum sized rotary solenoid, said selector switch relay comprising, an axially extending switch shaft carrying a plurality of substantially radially extending contacts, with said shaft being mounted for rotation about its axis, a detent wheel coaxial with said switch shaft and fixed thereto, spring means acting to maintain said detent wheel and shaft in a first position, a spring loaded drive bar mounted substantially perpendicular to a central axis of said shaft and resiliently biased in one direction along said axis and reciprocally movable along said axis, said drive bar being mounted in a slot whereby radial rotation of said bar about said shaft axis causes corresponding simultaneous rotation of said shaft and detent wheel, a drive ratchet coaxially mounted with respect to said shaft engaging said drive bar and carrying a plurality of angularly arranged inclined surfaces whereby reciprocal arcuate movement of said ratchet causes arcuate movement of said shaft and detent wheel in a single direction at predetermined arcuate increments, a rotary solenoid for driving said ratchet wheel, said spring means acting to multiply arcuate movement in said shaft over corresponding arcuate movement of said ratchet means whereby a solenoid with a small degree of arcuate movement and high power can be used to cause a high degree of arcuate movement in said switch shaft.

2. A rotary selector switch relay device in accordance with claim 1 wherein a spring abuts said drive bar and acts to prevent substantial radial movement of said bar.

3. A rotary selector switch relay device in accordance with claim 1 wherein said detent wheel carries an extension coaxial with said drive ratchet and mounting a spring for maintaining said drive bar in a predetermined radial position.

4. A rotary selector switch relay device in accordance with claim 3 wherein said extension of said detent wheel defines a notch carrying said drive bar for reciprocal movement therein in a first and second direction along the axis of said switch shaft.

5. A rotary selector switch relay device in accordance with claim 4 wherein said spring means comprising a roller pivotally mounted on a lever arm, said detent wheel comprising a plurality of peaks and valleys with said roller resting in a first valley and said arm being pivotally mounted to enable said roller to pass successively from one valley to another as said detent wheel is rotated, said spring means further comprising a spring urging said roller into a valley, whereby when said detent wheel turns about said shaft axis, spring pressure builds up at a first leg of travel of said roller wheel as it rides up a peak of the detent so that as it passes the peak and rides down the next side, said built up spring pressure provides a driving force to further turn said detent wheel along with said switch shaft.

6. A rotary selector switch relay device in accordance with claim 5 and further providing a second spring means identical to said first-mentioned spring means and carrying a pivotally mounted roller having a pivot axis substantially 180 degrees about said detent wheel from a pivot axis of said roller of said first-mentioned spring means.

7. A rotary selector switch relay device in accordance with claim 1 and further comprising manual handle means connected with said switch shaft to enable manual switching of said shaft into a plurality of preselected arcuate positions.

8. A rotary solector switch relay device in accordance with claim 7 wherein said handle is located at an end of said shaft and said drive ratchet and solenoid are located at another end of said shaft.

9. An automatic electrical contact opening and closing mechanism in accordance with claim 7 wherein said shaft is a shaft of a rotary solenoid having a predetermined degree of arcuate movement about its axis, said electrical contact mounted on said contact arm and said fixed contact when in engagement, activating arcuate movement of said solenoid shaft whereby said mechanism is an interrupter mechanism for automatic stepping of said switch shaft to alternate switch positions about the switch shaft axis.

10. A rotary selector switch relay device in accordance with claim 8 wherein said radial solenoid defines a solenoid shaft substantially coaxial with said switch shaft and mounting said ratchet wheel at one end, a second end of said rotary solenoid shaft comprising an automatic electrical contact opening and closing mechanism with said mechanism comprising, a track arm carrying a cam track with said arm fixed to said shaft for reciprocal arcuate movement therewith.

a contact arm mounted at a pivot point and carrying a cam follower pin engaging said cam track, an electrical contact fixed to said contact arm, first spring means urging said contact arm and contact with a first spring force into a first position where said contact is in electrical engagement with a fixed contact, and second spring means mounted to assert a second spring force on said contact arm opposed to the urging of said first spring means, said second spring force building in magnitude upon pivoting of the cam track to overcome said first spring force and cause snap disengagement of said contact and fixed contact with reciprocal pivoting causing said first spring force to overcome said second spring force.

11. A rotary selector switch relay device in accordance with claim 8 wherein said detent wheel and said roller are so arranged and spring biased that said spring powers said detent wheel after arcuate rotation of said rotary solenoid to a point less than the full degree of travel of said rotary solenoid.

12. A rotary selector switch relay device in accordance with claim 1 wherein said switch shaft has eight arcuate switching positions and carries a plurality of contacts at preselected positions along its length.

13. An automatic electrical contact opening and closing mechanism for use with a shaft which is mounted for a predetermined arcuate movement about an elongated shaft axis, said mechanism comprising a track arm carrying a cam track with said arm fixed to said shaft for reciprocal arcuate movement therewith in a path of less than 360°, a contact arm mounted at a pivot point and carrying a cam follower pin engaging said cam track.

an electrical contact fixed to said contact arm, first spring means urging said contact arm and contact with a first spring force into a first position where said contact is in electrical engagement with a fixed contact, and second spring means mounted to assert a second spring force on said contact arm opposed to the urging of said first spring means at a preselected time, said second spring force building in magnitude upon pivoting of said cam track to overcome said first spring force at said preselected time and cause snap disengagement of said contact and fixed contact with reciprocal pivoting of said cam track causing said first spring force to overcome said second spring force only when said cam track returns to its original arcuate position.

14. An automatic electrical contact opening and closing mechanism in accordance with claim 13 and further comprising said first and second spring means being coil springs.

15. An automatic electrical contact opening and closing mechanism in accordance with claim 13 and further comprising said cam track being an enclosed encircling path.

16. An automatic electrical contact opening and closing mechanism in accordance with claim 15 wherein said shaft is interconnected with a rotary solenoid of an electrical rotary selector switch.

17. A rotary selector switch relay device ratchet means comprising, an open faced rotary ratchet having a plurality of inclines arranged about an axis, bar means engaging said rotary ratchet with said bar and ratchet being mounted for rotation about a shaft axis and with said bar being perpendicular to said shaft axis, spring means urging said ratchet and bar into engagement but permitting movement of said bar and ratchet with respect to each other upon actuation of one of said bar or ratchet.

* * * * *